United States Patent [19]

Bassinger

[11] 4,003,442

[45] Jan. 18, 1977

[54] DETACHABLE DRILL BIT FOR IMPACT DRILLING

[75] Inventor: Ross Bassinger, San Antonio, Tex.

[73] Assignee: Reed Tool Company, Houston, Tex.

[22] Filed: Oct. 6, 1975

[21] Appl. No.: 619,931

[52] U.S. Cl. ..... 175/410; 173/80; 173/132

[51] Int. Cl.[2] ..... E21C 13/00

[58] Field of Search ..... 175/92, 293, 410; 173/73, 80, 132

[56] References Cited

UNITED STATES PATENTS

| | | | |
|---|---|---|---|
| 3,050,032 | 8/1962 | Carey | 173/132 |
| 3,167,136 | 1/1965 | Cook | 173/80 X |
| 3,195,657 | 7/1965 | Collier | 173/73 X |
| 3,709,306 | 1/1973 | Curington | 173/132 |
| 3,795,283 | 3/1974 | Oughton | 175/92 X |
| 3,924,690 | 12/1975 | Shaw | 173/80 X |

*Primary Examiner*—Ernest R. Purser
*Assistant Examiner*—Richard E. Favreau
*Attorney, Agent, or Firm*—Cox, Smith, Smith, Hale & Guenther Incorporated

[57] ABSTRACT

An impact drilling apparatus has an anvil inside a casing for receiving impact blows from a hammer. The lower end of the anvil is threadably connected to a drill bit having an external load bearing shoulder. On the lower end of the casing is attached a driver guide sub which extends downwardly around the threaded connection between the drill bit and anvil to bear on the external load bearing shoulder for transmitting down weight to the bit and simultaneously counteracting lateral forces acting on the bit and anvil. A spline connection is provided between the driven guide sub and the anvil. In the off bottom position, a shoulder of the anvil comes to rest against the top of the driver guide sub which stops the reciprocating action of the hammer while drilling fluid continues to flow.

9 Claims, 1 Drawing Figure

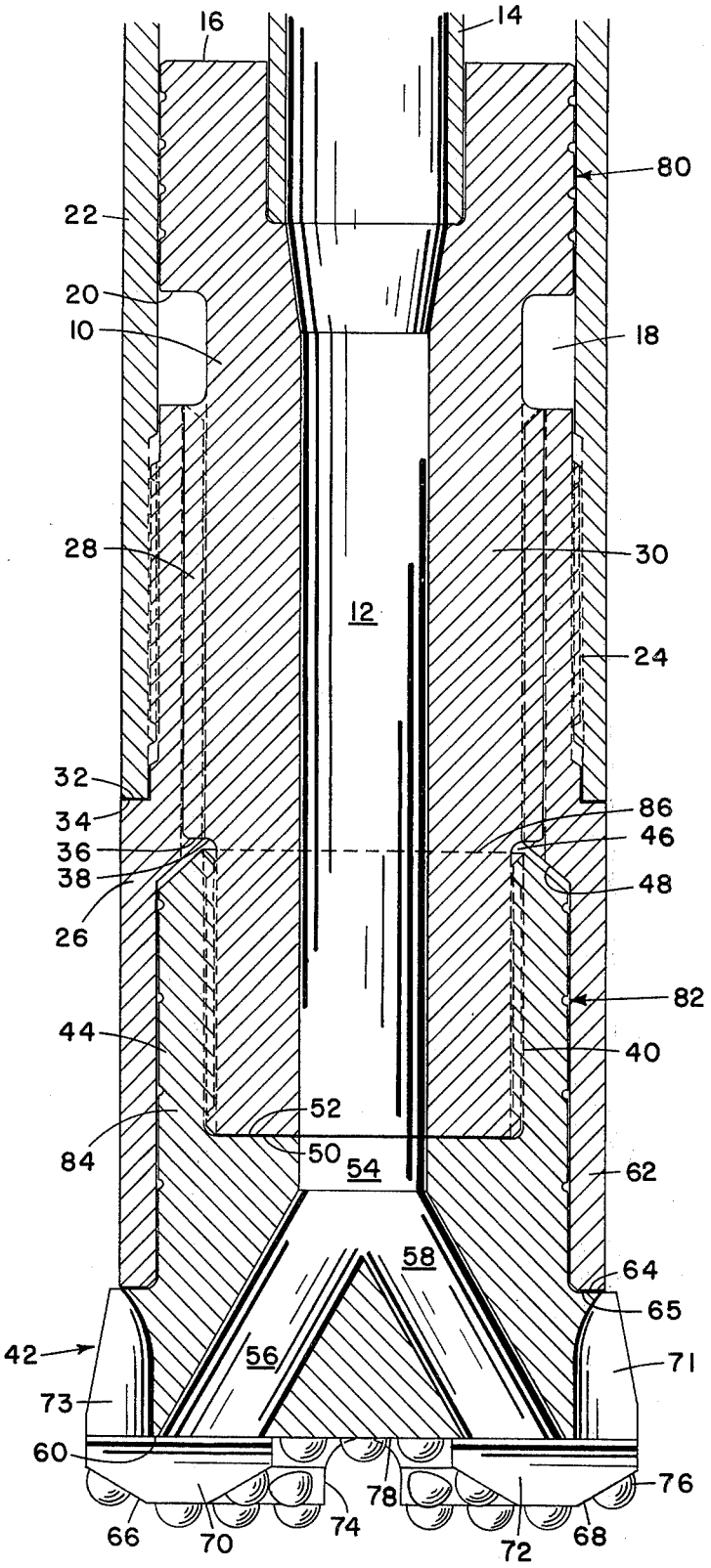
16
14
80
22
20
10
18
28
30
12
24
32
34
86
36
46
38
48
26
82
44
40
52
84
50
54
62
58
64
65
42
56
71
73
60
76
78
66
70
74
72
68

DETACHABLE DRILL BIT FOR IMPACT DRILLING

BACKGROUND OF THE INVENTION

This invention relates to drill bits and, more particularly, to earth boring drill bits used in percussion drilling. The drill bit is detachable so that it may be readily replaced when worn with the minimum amount of waste.

Since the detachable drill bit (as will be subsequently described) is designed for use in impact drilling, a typical impact drilling apparatus is shown in application Ser. No. 507,968 filed on Sept. 20, 1974, which application is incorporated by reference. However, it should be realized that other types of impact drilling apparatus may be used even though the present invention is shown in conjunction with the incorporated reference.

BRIEF DESCRIPTION OF THE PRIOR ART

Earlier types of drill bits used for drilling through the earth's formations were simply bits that would screw into a lower sub of a string of drilling pipe. In the beginning these bits were normally of the solid head, cross type with a fluid such as air or drilling mud being used to raise the cuttings to the surface. Other types of solid head bits were developed as time passed. Later roller cone bits were developed and used to counteract the tremendous wear that occurred to the outer edges of the solid head bits due to drag.

As drilling technology increased, it was found that impacting blows of the drill bit against the earth's formations greatly increased the drilling penetration rate especially through hard formations. Therefore, the drilling industry started using impacting devices, which normally consisted of a hammer and anvil arrangement inside of the casing with the drill bit being below the anvil. Some of the earlier inventions attempted to connect the bit to the anvil by a simple threaded connection, Oughton (U.S. Pat. No. 3,795,283) and Carey (U.S. Pat. No. 3,050,032) being typical examples. Many times, however, when the drill bit was threadably connected to the end of an anvil, either the anvil or bit would break at the threaded connection long prior to the bit being worn out. This resulted in a tremendous loss to the operator of the drilling rig in replacement parts, and from down time when the broken parts were being replaced.

To counteract this problem the industry has in recent years been making the anvil and bit as one integral piece. This eliminates the problem of breakage of the bit from the anvil; however, there is a tremendous waste of material because both the anvil and bit must be replaced once the bit is worn out. As a normal rule, one anvil should be able to wear out five or six bits before there is an appreciable amount of wear on the anvil.

The forces that normally break the threaded connection between a bit and anvil are the lateral forces that may be exerted on the drill bit in conjunction with shock forces of the hammer impacting the anvil. For example, assume that the drill bit is drilling through a slant rock with substantially all of the down weight on the drill bit being opposed by the formation acting against one side of the bit. This would cause a bending moment about the threaded connection of the bit to the anvil which is equal to the down weight times the radius of the drill bit. Combine this with the shock forces that exist in percussion drilling and the connection between the drill bit and the anvil is very prone to break.

In the prior art apparatus that used the solid anvil and bit combination, there was an additional expense in manufacturing and assembly. A means for holding the anvil and bit combination inside of the casing had to be provided. Normally a snap ring inside of an internal groove of the casing would be located below an upper lip of the anvil. A lower sub would slideably hold the combined anvil and bit into position between given limits of movement. The means for holding the combined anvil and bit inside the casing caused substantial increases in the cost of manufacturing.

SUMMARY OF THE INVENTION

It is an object of the present invention to provide a detachable drill bit for impact drilling.

It is another object of the present invention to provide a detachable drill bit threadably connected to an anvil with a driver guide sub extending substantially below the threaded connection.

It is yet another object of the present invention to provide a detachable drill bit for impact drilling wherein the drill bit screws over the anvil and is contiguous with a driver guide sub that extends below the threaded connection and rests against a lower shoulder of the drill bit.

It is yet another object of the present invention to provide a driver guide sub for impact drilling wherein the driver guide sub counteracts the lateral forces on the drill bit thereby preventing stresses on a threadable connection between the drill bit and the anvil.

An anvil with the center flow passage therethrough is contained inside of a casing. Threadably connected to the lower end of the casing is a driver guide sub which has a spline connection with the anvil. Threadably connected to the lower end of the anvil, and contiguous with the driver guide sub, is a drill bit. A lower shoulder of a drill bit, well below the threaded connection with the anvil, pushes upward against the bottom of the driver guide sub. Flow passages through the drill bit communicate the drilling fluid from the anvil to the bottom of the drill bit. The drill bit, which is of the solid head type, may have any particular design on the lower end thereof as long as the design is efficient for drilling through the earth's formations.

BRIEF DESCRIPTION OF THE DRAWINGS

The FIG. is an elevated cross sectional view of the drill bit, driver guide sub and anvil assembled inside of a casing.

BRIEF DESCRIPTION OF THE PREFERRED EMBODIMENT

Referring now to the FIG. there is shown a portion of an impact drilling apparatus beginnning with the anvil 10. Portions above the anvil 10 may be made substantially identical to the previously incorporated reference, Ser. No. 507,968. The anvil 10 has a center flow passage 12 extending therethrough. An exhaust feeder 14 surrounds the center flow passage 12 in the anvil head 16. Below the anvil head 16 is located an annular undercut 18 which forms shoulder 20.

The anvil 10 is located inside of casing 22. The lower end of casing 22 is connected by means of threads 24 to driver guide sub 26. The upper portion of driver guide sub 26 has a spline connection 28 with anvil 10 to allow a slideable connection therewith. The spline connection 28 is located on what is commonly called the shank 30 of the anvil 10. A shoulder 32 of the driver guide sub 26 abuts the end 34 of casing 22.

Below the spline connection 28, the shank 30 of the anvil 10 has a reduced diameter thereby forming a shoulder 36. The shoulder 36 is formed with a small radii 38 to help prevent breaking. On the lowermost portion of the shank 30 is a threaded connection 40 with bit 42. The threads on bit 42 for threaded connection 40 are provided on an internal portion of upper annular extension 44. It should be realized that upper annular extension 44 is contiguous with driver guide sub 26. However, once bit 42 is tightened onto shank 30 of anvil 10. a space 46 will be left between shoulder 48 of driver guide sub 26 and the top of upper annular extension 44. The bit 42 has been raised as much as possible as shown in the FIG., with lower shoulder 64 of bit 42 abutting end 65 of driver guide sub 26, as will subsequently be described in more detail. Simultaneously the bottom 50 of anvil 10 is flush with weight bearing internal shoulder 52 of bit 42.

Inside of bit 42 is located short center flow passage 54 to receive drilling fluid from center flow passage 12 of anvil 10. From short center flow passage 54, sloping flow passages 56 and 58 communicate the drilling fluid to the bottom 60 of bit 42.

Extending downward around the upper annular extension 44 of bit 42 and well below the threaded connection 40 is a guide portion 62 of driver guide sub 26. The guide portion 62 is in a slideable contiguous relationship with bit 42 to counteract any bending moments that may be felt through drill bit 42. The end 65 of guide portion 62 abuts lower shoulder 64 which encircles bit 42.

While the construction of the bottom 60 of bit 42 is not essential to the present invention, the preferred embodiment shows a four lobe solid head bit with hardened inserts. By referring to the FIG. lobes 66 and 68 and can be seen with hardened inserts 76 located therein. Between the lobes 66 and 68 (two other lobes not being shown in the cross sectional view) are located cross notches 70, 72 and 74. Upper flow notches 71 and 73 connect with cross notches 72 and 70, respectively. The hardened inserts 76 are located not only on the lobes 70 and 72, but also in the bottom center face 78 as shown. The construction of the bottom 60 of bit 42 allows the drilling fluid to flow into the cross notches 70 and 72, around the hardened inserts 76 to remove any cuttings and up through the annulus of the hole. Upper flow notches 71 and 73 simply aid in the flow of the drilling fluid up around the drill bit 42.

METHOD OF OPERATION

In actual operation a drilling fluid will be flowing through center flow passage 12 in surges. The drilling fluid which is of a substantially raised pressure, will also be exerting pressure against seal area 80 of anvil 10, which forms a metal to metal seal with casing 22. Likewise, the drilling fluid will be exerting a pressure on seal area 82 of bit 42 which forms a metal to metal seal with guide portion 62.

While drilling, a down weight will be exerted on the drill bit 42 through casing 22 and driver sub 26. The end 65 of driver guide sub 26 abuts shoulder 64 of bit 42 thereby forcing the bit 42 against the earth's formations. By simultaneously rotating the string of drilling pipe including casing 22 and driver guide sub 26, the bit 42 is simultaneously rotated by anvil 10. Assuming that the bit 42 is drilling through a sloping hard formation, only one corner of drill bit 42 will have to withstand all of the down weight exerted through casing 22. This means that a bending moment will be exerted back up through the drill bit 42 and anvil 10 that will be substantially equal to the radius of the drill bit 42 times the down weight, but this bending moment is counteracted by the end 65 of the driver guide sub 26 acting on shoulder 64 of bit 42. Now combine the bending moment that is exerted by normal down weight on the drill bit 42 with the additional bending moment of periodic impacts of a hammer against anvil head 16 and a tremendously increased bending moment is felt in bit 42 and anvil 10. The shock effect of the hammer (not shown) impacting the anvil 10 is felt through the threaded connection 40 of bit 42 due to the opposing forces of the earth's formation.

In prior devices anvils have had a tendency to break in area 86 and bits have had a tendency to break in area 84. In the present invention area 86 is as large as possible, and stress concentrations are avoided by using smooth radii in the thread roots and runout. This reduces the probability of breakage due to bending moments felt through bit 42 to the anvil 10. Likewise, there is a reduction of probability that either the anvil 10 will break in area 86 or that bit 42 will break in area 84 due to the driver guide sub 62. By extending the driver guide sub 62 as low as possible, and in a contiguous slideable relationship with upper annular extension 44, much of the bending moments exerted by the earth's formations against bit 42 will be opposed by the driver guided sub 26 through the guide portion 62. This will eliminate a large portion of the stress felt by threaded connection 40 and consequently reduce the probability of breakage in area 84 of bit 42 and area 86 of anvil 10. The down weight from the surface is being applied as close to the bottom 60 of bit 42 as possible by having lower shoulder 64 located well below the threaded connection 40 and close to the bottom 60 of the bit 42. Likewise, when the anvil 10 drives the bit 42 downward so that end 65 of guide portion 62 is no longer abutting shoulder 64, the guide 62 will still counteract bending moments exerted by the earth's formations.

In prior devices there was a problem of assembly of the anvil and bit inside of the casing. Normally an undercut would have to be provided in a casing somewhere below shoulder 20 of anvil 10 with a snap ring holding the anvil in position. In the present invention, if the bit 42 is raised off of the earth's formation, anvil 10 will slide downward until shoulder 20 comes to rest against the top of driver guide sub 26. This will stop the reciprocating action of the hammer as described in the incorporated reference, and simultaneously allow drilling fluid to continue to flow through the anvil 10 and drill bit 42.

I claim:

1. A drilling bit for use in a percussion drilling tool having a casing, a driver sub, and an anvil member slidably positioned in said sub; said bit having an external cutting surface, a circumferential shoulder, and a sliding surface extending from said shoulder for telescopic continuous engagement with said driver sub, and means on said bit spaced from said shoulder for releasably connecting said bit to said anvil member and located entirely within said driver sub during normal operation of said drilling tool so that bending moments are transmitted through said sliding surface to said driver sub.

2. A drilling bit according to claim 1 in which said bit has hardened inserts in said cutting surface and flow passages therethrough for passing fluid to said cutting surface to remove cuttings from operation of said bit.

3. A drilling bit according to claim 1 in which said connecting means is a threaded connection.

4. A drilling bit according to claim 3 in which said sliding surface of said bit comprises a hollow cylindrical portion having a threaded bore, and the lower end of said anvil is threaded and adapted to be releasably connected in said threaded bore.

5. The combination with a percussion drilling tool comprising a casing having an inlet for receiving pneumatic fluid, a driver sub, at the lower end of said casing, a hammer piston slidably positioned in said casing for actuation by pneumatic fluid, and an anvil member slidably positioned in said driver sub for operation by said hammer piston; of a drilling bit having an external cutting surface, a circumferential shoulder, and a sliding surface extending from said shoulder for telescopic continuous engagement with said driver sub, and means on said bit spaced from said shoulder releasably connecting said bit to said anvil member and located entirely within said driver sub during normal operation of said drilling tool so that bending moments are transmitted through said sliding surface to said driver sub.

6. The combination according to claim 5 in which said bit has hardened inserts in said cutting surface and flow passages therethrough for passing fluid to said cutting surface to remove cuttings from operation of said bit.

7. The combination according to claim 5 in which said driver sub is threadedly connected to said drill casing, and an upper surface of said driver sub abuts a shoulder on said anvil member to prevent said anvil member from coming out from said casing when said drilling tool is raised.

8. The combination according to claim 5 in which said connecting means is a threaded connection.

9. The combination according to claim 8 in which said sliding surface of said bit comprises a hollow cylindrical portion having a threaded bore, and the lower end of said anvil member is threaded and releasably connected in said threaded bore.

* * * * *